US009415480B2

(12) United States Patent
Aoki et al.

(10) Patent No.: US 9,415,480 B2
(45) Date of Patent: Aug. 16, 2016

(54) ABRASIVE PAD AND METHOD FOR ABRADING GLASS, CERAMIC, AND METAL MATERIALS

(71) Applicant: 3M INNOVATIVE PROPERTIES COMPANY, St. Paul, MN (US)

(72) Inventors: Toru Aoki, Sagamihara (JP); Akira Yoda, Machida (JP); Takayuki Tachihara, Sagamihara (JP)

(73) Assignee: 3M Innovative Properties Company, St. Paul, MN (US)

( * ) Notice: Subject to any disclaimer, the term of this patent is extended or adjusted under 35 U.S.C. 154(b) by 23 days.

(21) Appl. No.: 14/413,330

(22) PCT Filed: Jul. 8, 2013

(86) PCT No.: PCT/US2013/049513

§ 371 (c)(1),
(2) Date: Jan. 7, 2015

(87) PCT Pub. No.: WO2014/011517

PCT Pub. Date: Jan. 16, 2014

(65) Prior Publication Data

US 2015/0158141 A1 Jun. 11, 2015

(30) Foreign Application Priority Data

Jul. 13, 2012 (JP) ..... 2012-158007

(51) Int. Cl.
*B24B 37/26* (2012.01)
*B24B 37/24* (2012.01)
(Continued)

(52) U.S. Cl.
CPC . *B24B 37/26* (2013.01); *B24B 7/24* (2013.01); *B24B 7/242* (2013.01); *B24B 37/22* (2013.01); *B24B 37/245* (2013.01); *B24D 11/00* (2013.01)

(58) Field of Classification Search
CPC ..... B24B 37/26; B24B 7/24; B24B 7/242; B24D 11/00
USPC ..... 451/41, 524–530
See application file for complete search history.

(56) References Cited

U.S. PATENT DOCUMENTS 2,001,911 A * 5/1935 Wooddell ..... B24D 11/00 451/529
2,050,992 A * 8/1936 Aust ..... B24D 11/00 451/539

(Continued)

FOREIGN PATENT DOCUMENTS

JP 2001-088041 4/2001
KR 2000 0024453 5/2000

(Continued)

OTHER PUBLICATIONS

International Search Report for PCT International Application No. PCT/US2013/049513, mailed on Sep. 12, 2013, 4pgs.

*Primary Examiner* — George Nguyen
(74) *Attorney, Agent, or Firm* — Scott A. Baum; David B. Patchett

(57) ABSTRACT

An abrasive pad used to abrade the surfaces of glass, ceramic, and metal materials, the abrasive pad being provided with a substrate layer, and an abrasive layer provided on a first surface side of the substrate layer and including an abrasive material, and the abrasive layer having a plurality of base portions arranged mutually separated on the substrate layer, columnar or frustum shaped tip portions arranged mutually separated on the base portions, and a group of grooves containing a plurality of groove portions provided between base portions such that the substrate layer is exposed, with each of the grooves mutually intersecting.

8 Claims, 9 Drawing Sheets

(51) Int. Cl.

| | |
|---|---|
| ***B24D 11/00*** | (2006.01) |
| ***B24B 7/24*** | (2006.01) |
| ***B24B 37/22*** | (2012.01) |

(56) References Cited

U.S. PATENT DOCUMENTS

| | | | | | |
|---|---|---|---|---|---|
| 2,347,244 | A * | 4/1944 | Colt | B24D 11/00 | 451/527 |
| 2,907,146 | A * | 10/1959 | Dyar | B24D 11/00 | 451/529 |
| 4,788,798 | A * | 12/1988 | DeFranco | B24B 13/01 | 428/212 |
| 5,199,227 | A * | 4/1993 | Ohishi | B24D 11/00 | 451/527 |
| 5,449,388 | A * | 9/1995 | Wiand | B24B 7/22 | 51/293 |
| 5,454,844 | A * | 10/1995 | Hibbard | B24D 3/28 | 451/296 |
| 5,489,233 | A * | 2/1996 | Cook | A47L 13/28 | 451/41 |
| 5,681,217 | A * | 10/1997 | Hoopman | B24D 11/00 | 451/526 |
| 6,126,533 | A | 10/2000 | Johnson | | |
| 6,241,596 | B1 * | 6/2001 | Osterheld | B24B 37/26 | 451/41 |
| 6,439,986 | B1 | 8/2002 | Myoung | | |
| 6,634,929 | B1 | 10/2003 | Visser | | |
| 6,722,952 | B2 | 4/2004 | Goers | | |
| 6,761,607 | B2 | 7/2004 | Kikuchi | | |
| 6,818,029 | B2 | 11/2004 | Myoung | | |
| 6,837,780 | B1 * | 1/2005 | Broido | B24B 37/16 | 451/287 |
| 6,866,566 | B2 * | 3/2005 | Taylor | B24B 53/12 | 451/443 |
| 7,404,756 | B2 * | 7/2008 | Ouderkirk | B24D 18/0009 | 257/E33.071 |
| 7,594,845 | B2 * | 9/2009 | Lugg | B24D 11/001 | 451/28 |
| 7,662,028 | B2 | 2/2010 | Feng | | |
| 8,177,604 | B2 * | 5/2012 | Ujihara | B24B 21/004 | 451/28 |
| 8,425,278 | B2 * | 4/2013 | Culler | B24D 11/00 | 451/41 |
| 2006/0079160 | A1 | 4/2006 | Balagani | | |
| 2006/0258276 | A1 | 11/2006 | Sung | | |
| 2008/0220702 | A1 * | 9/2008 | Feng | B24B 37/26 | 451/527 |
| 2011/0053460 | A1 | 3/2011 | Culler | | |

FOREIGN PATENT DOCUMENTS

| | | |
|---|---|---|
| WO | 94/27595 | 12/1994 |
| WO | WO 96/14964 | 5/1996 |
| WO | WO 2006/057714 | 6/2006 |
| WO | WO 2010/009420 | 1/2010 |
| WO | WO 2011/087653 | 7/2011 |

* cited by examiner

ABRASIVE PAD AND METHOD FOR ABRADING GLASS, CERAMIC, AND METAL MATERIALS

CROSS REFERENCE TO RELATED APPLICATIONS

This application is a national stage filing under 35 U.S.C. 371 of PCT/US2013/049513 filed Jul. 8, 2013, which claims priority to JP Patent Application No. 2012-158007, filed Jul. 13, 2012, the disclosures of which are incorporated by reference in their entirety herein.

BACKGROUND

The present invention pertains to an abrasive pad and a method for abrading glass, ceramic, and metal materials.

Conventional abrasive pads include, for example, an abrading component as described in PCT Application No. 2002-542057. The abrading component thereof is configured as provided with a backing material having an abrasive material on one surface. The shape of the abrasive material may, for example, be a cube, a block form, cylindrical, rectangular, or the like. Moreover, with an abrading component described in the specification of U.S. Unexamined Patent Application Publication No. US 2011/0053460, a conical protrusion is formed on a base portion of an abrasive layer formed of an abrasive material. An object of this protrusion is to simplify the initial dressing (an operation performed to obtain a flat abrasive surface), and to determine when the dressing is complete (when the abrasive surface has become flat). By shaving away the protrusion through dressing to create flatness, a base portion having uniform abrasive material can be used to implement abrading.

When abrading wire-reinforced glass, heat-resistant glass, or another glass substrate for industrial use, or when abrading a large substrate containing a ceramic or metal material, extending the useful life of an abrasive pad is essential. A conceivable measure to extend the useful life of an abrasive pad is to increase the height of the protrusion portion of the abrasive layer to increase the volume. However, when the height of the protrusion portion is simply increased, in some cases the protrusion portion can easily collapse. Therefore, connecting the root portion of the protrusion portion at the abrasive material layer is also conceivable. However, with this configuration as well, countermeasures are necessary to deal with a decrease in the flatness of the abrasive layer due to contraction when resin is light cured, and with a decrease in flexibility due to the integration of the abrasive layer.

SUMMARY

One aspect of the present invention is an abrasive pad used to abrade the surfaces of glass, ceramic, and metal materials, the abrasive pad being provided with a substrate layer and an abrasive layer provided on a first surface side of the substrate layer and including an abrasive material, and the abrasive layer having a plurality of base portions arranged mutually separated on the substrate layer, columnar or frustum shaped tip portions arranged mutually separated on the base portions, and a group of grooves including a plurality of groove portions provided between base portions such that the substrate layer is exposed between the base portions, with each of the grooves mutually intersecting.

Moreover, one aspect of the present invention is a method for abrading glass, ceramic, and metal materials using the above abrasive pad. The method includes a process of securing a second surface side of the substrate layer on a platen, bringing the abrasive layer and object for abrasion into contact, and then relatively rubbing the abrasive pad and a grinding fluid against the object for abrasion, while introducing the grinding fluid between the object for abrasion and the abrasive layer.

According to the present invention, an increased useful life of the abrasive pad can be achieved, and the flatness and flexibility of the abrasive layer can be ensured.

DETAILED DESCRIPTION

Preferred embodiments of an abrasive pad and a method for abrading glass, ceramic, and metal materials according to the present invention are described in detail below while referencing the figures.

Figure 1:
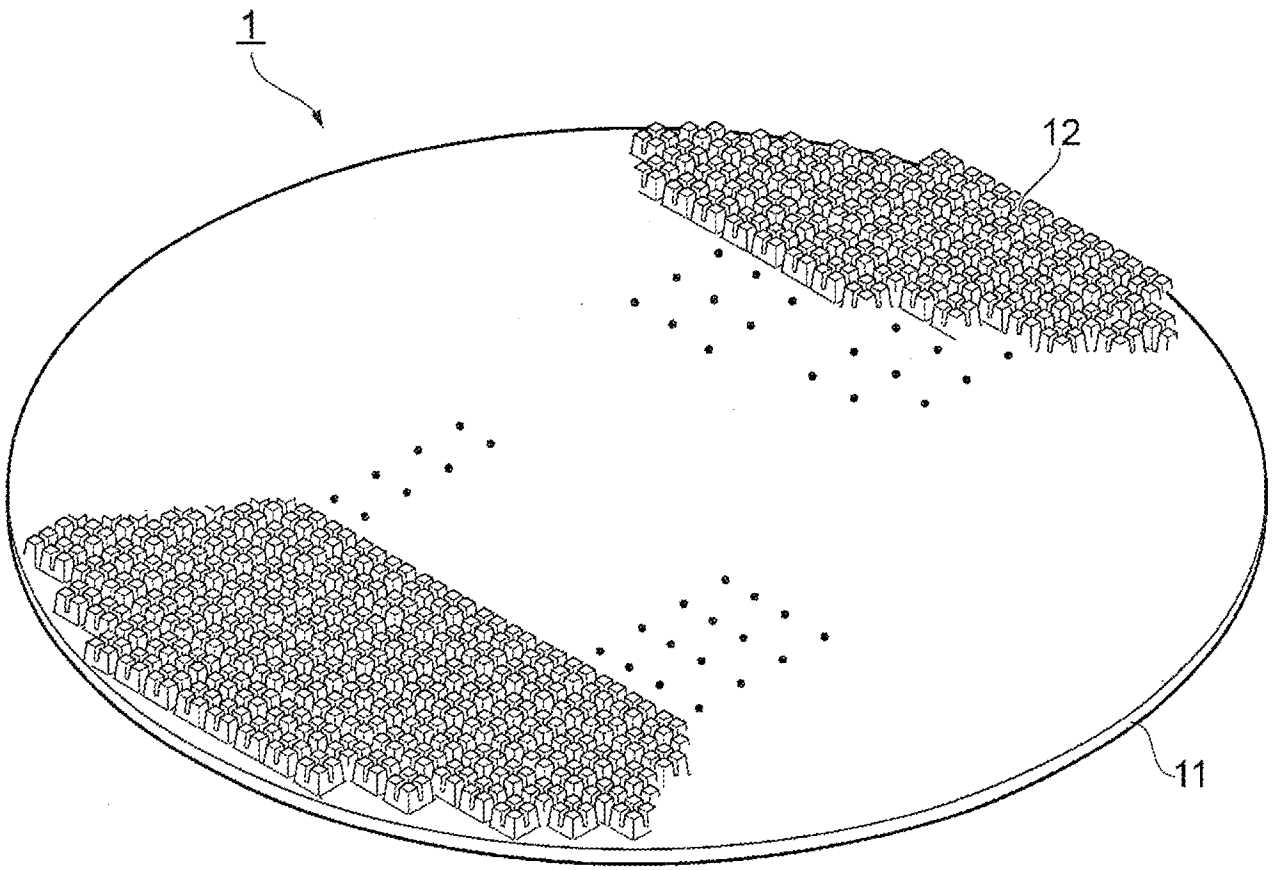
FIG. 1 is a perspective view showing an abrasive pad according to one embodiment of the present invention.
Figure 2:
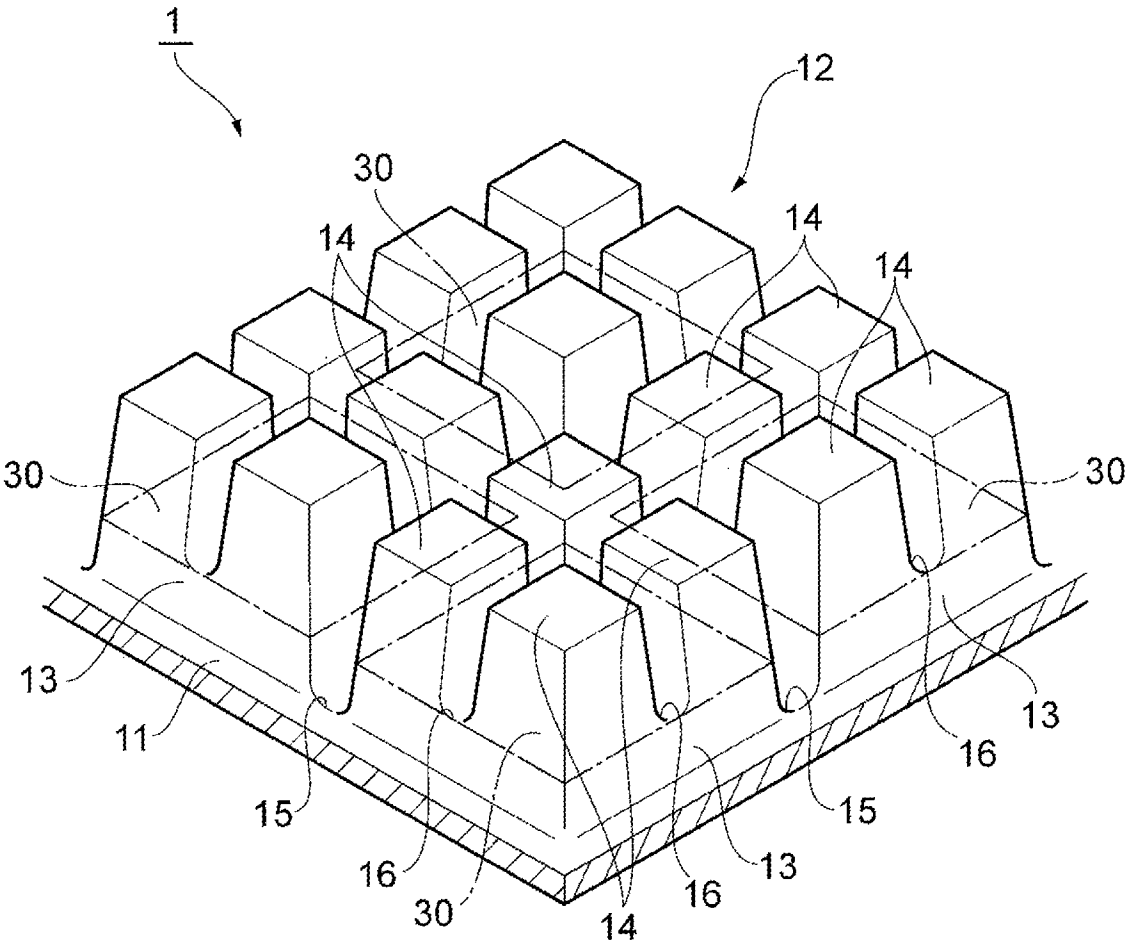
FIG. 2 is an enlarged perspective view showing the main parts of the abrasive pad illustrated in FIG. 1.
Figure 3:
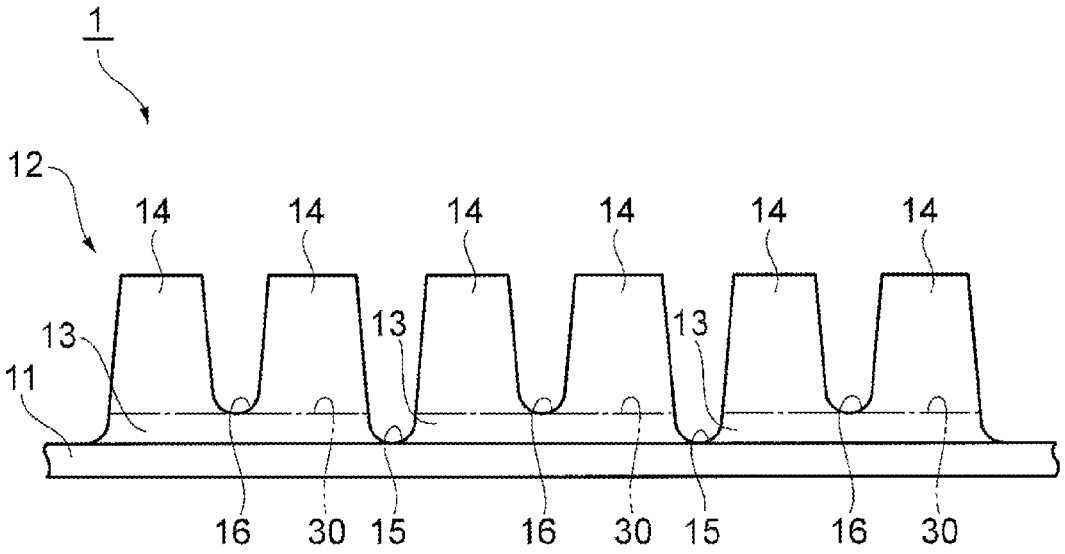
FIG. 3 is an enlarged side view showing the main parts of the abrasive pad illustrated in FIG. 1.

FIG. 1 is a perspective view showing an abrasive pad according to one embodiment of the present invention. Moreover, FIG. 2 is an enlarged perspective view showing the main parts of the abrasive pad illustrated in FIG. 1, and FIG. 3 is an enlarged side view thereof. As shown in FIGS. 1 to 3, an abrasive pad 1 is configured as provided with a substrate layer 11 that serves as a supporting member for the pad, and an abrasive layer 12 containing an abrasive material. The abrasive pad 1 is an abrasive pad that is used to abrade wire-reinforced glass, heat-resistant glass, or another glass substrate for industrial use, or to abrade a large substrate containing a ceramic or metal material. The abrasive pad 1, for example, forms overall a disk shape with a diameter of around 10 mm to 2500 mm.

The substrate layer 11, for example, is configured with a thickness of around 1 mm from polymer film, paper, vulcanized fiber, treated nonwoven material, treated fabric material, or the like such that the abrasive pad 1 has a certain amount of strength and flexibility. Of these materials, the use of polymer film is preferred. Examples of polymer film include polyethylene terephthalate film, polyester film, copolyester film, polyimide film, polyamide film, and the like.

The abrasive layer 12, for example, is configured including a binder, abrasive particles, and a filler, and is formed on one surface of the substrate layer 11. In addition, the abrasive layer 12 may also contain various components such as a coupling agent, a precipitation inhibitor, a hardening agent (initiator), and a photosensitizer.

The binder is formed from a binder precursor. The binder precursor contains a resin in an uncured or unpolymerized state, and when the abrasive layer 12 is fabricated, the resin in the binder precursor is polymerized or cured, forming a binder. The binder precursor uses a condensation curable resin, an addition-polymerizable resin, a free radical curable resin, or a combination thereof.

The abrasive particles are diamond bead abrasive particles, for example. The diamond bead abrasive particles used here, for example, are abrasive particles containing approximately from 6% to 65% by volume of diamond abrasive particles having a diameter of 25 micron or less, and are dispersed in a microporous, non-molten, continuous metal oxide matrix of approximately from 35% to 94% by volume. The metal oxide matrix has a Knoop hardness of approximately less than 1,000, and contains at least one metal oxide selected from a group that includes zirconium oxide, silicon oxide, aluminum oxide, magnesium oxide, and titanium oxide.

The amount of diamond bead abrasive particles contained in the abrasive layer 12 is ordinarily approximately 1 weight % or more, and is preferably approximately 2 weight % or more. Moreover, the amount of diamond bead abrasive particles contained in the abrasive layer 12 is more preferably approximately 5 weight % or more, and is most preferably approximately 7 weight % or more. The amount of diamond bead abrasive particles contained in the abrasive layer 12 is ordinarily approximately 30 weight % or less, and is preferably approximately 25 weight % or less. Moreover, the amount of diamond bead abrasive particles contained in the abrasive layer 12 is more preferably approximately 15 weight % or less, and is most preferably approximately 13 weight % or less.

In the formation of the abrasive layer 12, diamond abrasive particles are mixed with a metal oxide or an aqueous sol of an oxide precursor, and the obtained slurry is added to a dehydrated liquid (for example 2-ethyl-1-hexanol) that has been agitated. Water is then removed from the dispersion slurry, and the slurry thereof is then filtered, dried, and fired to obtain the abrasive layer 12. The diamond bead abrasive particles in the abrasive layer 12 are ordinarily a spherical shape, and are at least double in size compared to the original diamond particles used to fabricate abrasive particles.

The filler is a material that is used to control the speed of erosion of the abrasive layer 12. The filler is a particulate material having an average particle size of generally from 0.01 to 100 μm, and typically from 0.1 to 40 μm, for example. Controlling the speed of erosion of the abrasive layer 12 during abrading is important in order to achieve a balance between the abrading rate and useful life. If the filler loading is too high, the abrasive layer 12 may erode too fast, thereby resulting in an insufficient abrading operation. Conversely, if the filler loading is too low, the abrasive layer 12 may erode too slowly, thereby allowing the abrasive particles to dull, resulting in a decrease in the abrading rate.

The amount of filler contained in the abrasive layer 12 is ordinarily approximately 40 weight % or more, more preferably approximately 45 weight % or more, and most preferably 50 weight % or more. Moreover, the amount of filler contained in the abrasive layer 12 is ordinarily approximately 60 weight % or less.

Examples of fillers include, metal carbonates (such as calcium carbonate (chalk, calcite, peat, travertine, marble, and limestone), calcium magnesium carbonate, sodium carbonate, magnesium carbonate, and the like), silica (such as crystal, glass beads, glass bubbles, glass fibers, and the like), silicates (such as talc, clays (montmorillonite) feldspar, mica, calcium silicate, calcium metasilicate, sodium aluminosilicate, sodium silicate, lithium silicate, potassium silicate, and the like), metal sulfates (such as calcium sulfate, barium sulfate, sodium sulfate, aluminum sodium sulfate, aluminum sulfate, and the like), gypsum, vermiculite, wood powder, aluminum trihydrate, carbon black, metal oxides (such as calcium oxide (lime), aluminum oxide, tin oxide (for example stannic oxide), titanium dioxide, and the like), and metal sulfites (calcium sulfite and the like), thermoplastic particles (polycarbonate, polyetherimide, polyester, polyethylene, polysulfone, polystyrene, acrylonitrile-butadiene-styrene block copolymer, polypropylene, acetal polymers, polyurethane, nylon particles), and thermosetting particles (such as phenolic bubbles, phenolic beads, polyurethane foam particles, and the like), and the like.

The filler may also be a salt such as a halide salt. Examples of halide salts include sodium chloride, potassium cryolite, sodium cryolite, ammonium cryolite, potassium tetrafluoroborate, sodium tetrafluoroborate, silicon fluorides, potassium chloride, and magnesium chloride. Examples of metal fillers include tin, lead, bismuth, cobalt, antimony, cadmium, iron, and titanium. Examples of other fillers include sulfur, organic sulfur compounds, graphite, and metallic sulfides.

Next, a structure of the aforementioned abrasive layer 12 is described.

The abrasive layer 12 features a tile structure like those shown in FIGS. 2 and 3. More specifically, the tile structure of the abrasive layer 12 has a plurality of base portions 13 arranged mutually separated on the substrate layer 11, and a plurality of tip portions 14 arranged mutually separated on the base portions 13.

The base portions 13 are arranged in a matrix shape on the substrate 11 such that the density is from 0.01 to 80 base portions 13 per 1 $cm^2$, for example. Each base portion 13 has a flat, roughly cuboid shape with a thickness of 0.5 mm to 2.0 mm, for example, and a roughly square shape from a planar view. The base portion 13 is a rigid body, and if the thickness of the base portion 13 is too thick, there is a risk of the base portion 13 being easily affected by contraction. On the other hand, if the thickness of the base portion 13 is too thin, the abrasive layer 12 can more easily crack. The above range of thicknesses is favorable because in that range, the strength of the base portion 13 can be ensured, and impact from contraction is eliminated.

A surface area of a top face 30 (surface that forms a tip portion 14) of the base portion 13 is ordinarily 30 $mm^2$ or higher, preferably 50 $mm^2$ or higher, and more preferably 100 $mm^2$ or higher for a case in which oblong glass measuring 3 m×4 m is abraded, for example. Moreover, the surface area of the top face 30 of the base portion 13 is ordinarily 400 $mm^2$ or less, preferably 300 $mm^2$ or less, and more preferably 200 $mm^2$ or less. Of course, the optimum range differs depending on the object for abrasion and the machining pressure (the ordinary grinding pressure is approximately from 50 to 300 $g/cm^2$, for example).

By selecting a range such as this, a sufficient number of tip portions 14 can be arranged on the base portion 13, and an abrading region can be thoroughly ensured. Moreover, from a similar viewpoint as the case of thickness, if the surface area of the base portion 13 is too large, there is a concern that the flexibility of the substrate layer 11 may be lost. On the other hand, if the surface area of the base portion 13 is too small, the abrasive layer 12 becomes narrow, which could result in a decrease in abrading workability. Accordingly, within the above surface area ranges, both abrading workability and the flexibility of the substrate layer 11 can be ensured.

The planar shape of the top face 30 of the base portion 13 can be appropriately selected from polygons such as triangles, rectangles, hexagons, and the like, circular shapes including ellipse shapes, and the like. In the selection of this planar shape, consideration is given to contact of the abrasive pad 1 and the object for abrasion accompanying mutual rotational movement, or rotational movement of just one thereof, when abrading is implemented, and a shape that enables isotropic abrading to be performed is preferred. From this point of view, a circular, square, or other isotropic shape is more preferred than an oblong shape or other anisotropic shape for the planar shape of the top face 30 of the base portion 13. Moreover, by giving isotropy to the planar shape of the top face 30 of the base portion 13, isotropy can be allowed in the arrangement of the tip portions 14, and the tip portions 14 can be arranged in a high density on the base portion 13.

The three-dimensional shape of the base portion 13 may also be a columnar body or a frustum shaped body. In particular, a base portion 13 that is frustum shaped is preferred because stress is not easily concentrated in the angled parts, and the contact surface area with the substrate layer 11 is increased.

Here, the selection of the surface area of the base portion 13 will be described for a case in which the base portion 13 is arranged in a square lattice shape as an example. To simplify the description, the contribution of a two-dimensional surface to a magnitude relationship is replaced with the contribution of a one-dimensional width to the magnitude relationship and explained. In the selection of a width dimension of the base portion 13, the extent of undulation of the surface of the object for abrasion, the extent of the material strength of the object for abrasion, the external shape and dimensions of the object for abrasion, the height of the tip portions 14, and the like must be considered. A pitch of the undulation of the surface of the object for abrasion reaches about 1 μm for small objects, and about 1 m for large objects. Accordingly, for example, by combining the width of the pitch of the undulation and the width of the base portion 13, the abrasive surface can more closely contact the surface of the object for abrasion. Moreover, if the object for abrasion is formed of a material that does not easily deform, the undulation of the surface does not easily change during abrading, and therefore, decreasing the width of the base portion 13 makes it easier to make the abrasive surface closely contact the surface of the object for abrasion. On the other hand, if the object for abrasion is formed of a material that easily deforms, the undulation of the surface easily changes during abrading, and therefore, increasing the width of the base portion 13 makes it easier to make the abrasive surface closely contact the surface of the object for abrasion.

Moreover, a small object for abrasion has a diameter of around 20 mm, for example, and a large object for abrasion reaches to around 3 m×3 m, for example, and therefore, selection of the width of the base portion 13 according to these dimensions is preferred. In the relationship with the tip 14, when an aspect ratio of the tip 14 is high, the torque on the tip 14 (moment of force around the root of the base portion 13) when abrading becomes large, and therefore, it is preferable to thoroughly secure the width of the base portion 13 and retain the tip 14.

Neighboring base portions 13 are partitioned by groove portions 15 that are provided at a prescribed spacing on the substrate layer 11. For example, as shown in FIG. 3, the bottom portion of the groove portions 15 is an R-shape (round shape) with a radius of 0.8 mm on the substrate layer 11 such that the substrate layer 11 is exposed at the vertex portion of the bottom portion. Note that "exposure" of the substrate 11 as mentioned herein means that a thickness of the abrasive material at the bottom portion of the groove portions 15 that essentially does not hinder the flexibility of the substrate layer 11 is desired, and the substrate layer 11 does not necessarily have to be fully exposed at the bottom portion of the groove portions 15.

By forming this type of groove portion 15, the side surfaces of the base portion 13 have a root portion that takes on a tapered shape. If the object for abrasion with the abrasive pad 1 is a large substrate, a large load tends to be applied to the abrasive pad 1 resulting from the rigidity of the object for abrasion. Therefore, joint strength with regards to the substrate layer 11, and a configuration that alleviates the stress added during abrading are demanded in the abrasive layer 12. Therefore, by adopting a tapered shape for the side surface portions at the base portion 13, the contact surface area between the substrate layer 11 and the base portion 13 can be maintained, and joint strength with regards to the substrate layer 11 can be ensured. Moreover, because the root portion of the base portion 13 does not form a notch, stress added to the root portion of the base portion 13 during abrading can be alleviated.

Figure 4A:
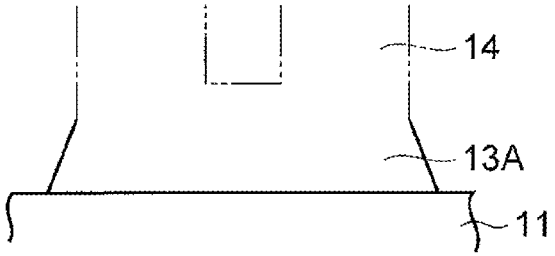
FIGS. 4*a* and 4*b* are side views showing a variation of the base portion.
Figure 4B:
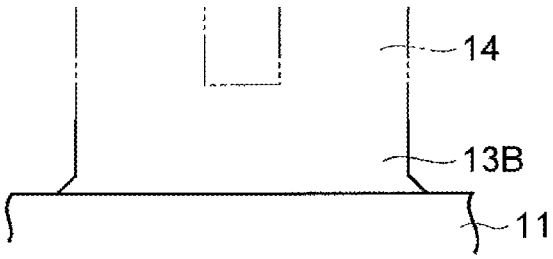

In addition to the rounded shape shown in FIG. 3, the tapered shape of the base portion 13 may also, for example, have side surfaces that are entirely slanted surfaces like a base portion 13A shown in FIG. 4*a*, and may have a surface shape (including a chamfered surface shape) in which only the root portions of the side surfaces are slanted surfaces like a base portion 13B shown in FIG. 4*b*. With these types of shapes as well, the contact surface area between the substrate layer 11 and the base portion 13 can be thoroughly maintained, and joint strength between the substrate layer 11 and the base portion 13 can be ensured. Moreover, because the root portion of the base portion 13 does not form a notch, localized stress concentration in the root portion of the base portion 13 can be prevented.

The width of the groove portions 15 can be appropriately selected, for example, in a range of approximately from 0.5 mm to 3 mm. If the width of the groove portions 15 is too narrow, there is a concern that the flexibility of the substrate layer 11 may decrease. Moreover, it is also conceivable that abrading scraps, which are generated when abrading an object to be abraded, could easily clog the groove portions 15, resulting in a drop in abrading efficiency. On the other hand, if the width of the groove portions 15 is too wide, the volume per unit surface area of the tip portions 14 arranged on the base portion 13 will become small, and the useful life of the abrasive pad 1 will decrease. Accordingly, by establishing the width of the groove portions 15 within the above range, the abrading efficiency of the abrasive pad 1 can be maintained and the useful life thereof can be ensured.

These groove portions 15 are arranged between neighboring base portions 13, and configure a group of grooves on the substrate layer 11. Requirements for the shape of the group of grooves include, for example, that the groove portions 15 themselves mutually communicate, and that mutually intersecting groove portions 15 are present.

Figure 5A:
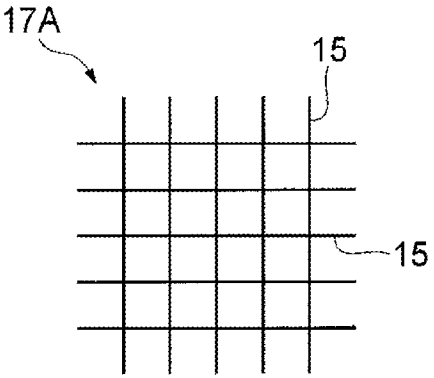
FIGS. 5*a-e* are outline views showing examples of groups of grooves formed between base portions.
Figure 5B:
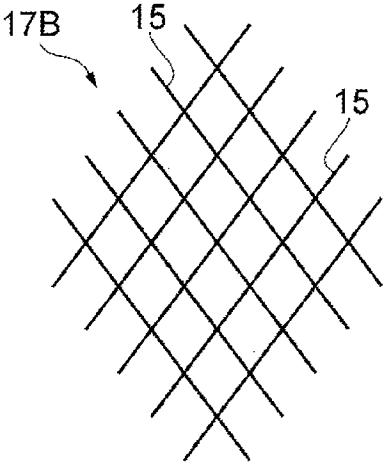

FIGS. 5*a-e* show examples of shapes of groups of grooves between base portions 13 and 14. In this figure, the groove portions 15 are represented by lines for convenience of description. As shown in FIG. 5*a*, a group of grooves 17A is given as an example of a configuration of a group of grooves, wherein straight line shaped groove portions 15 are arranged in a lattice shape. The group of grooves 17A forms a square lattice in which horizontal and vertical groove portions 15 are orthogonal. This configuration is superior in that abrading isotropy is maintained even when there is accompanying mutual rotational movement of the abrasive pad 1 and the object for abrasion or rotational movement of just one thereof when abrading is implemented. The intersecting angles of the groove portions 15 may be approximately from 45° to 135° similar to the group of grooves 17B shown in FIG. 5*b*. In this case as well, a certain amount of abrading isotropy can be maintained.

Figure 5C:
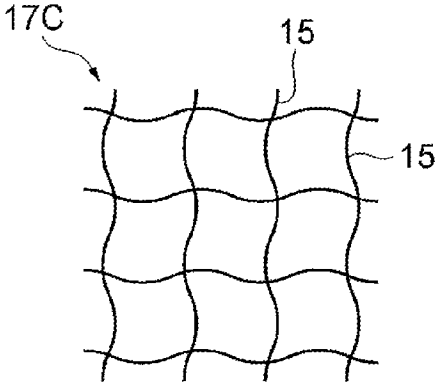
Figure 5D:
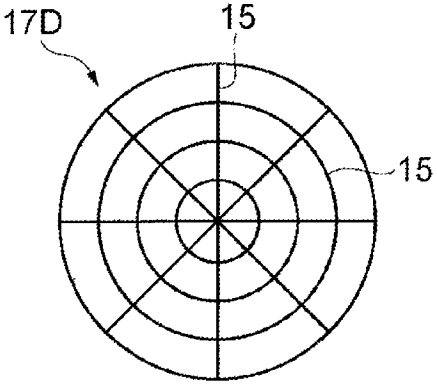
Figure 5E:
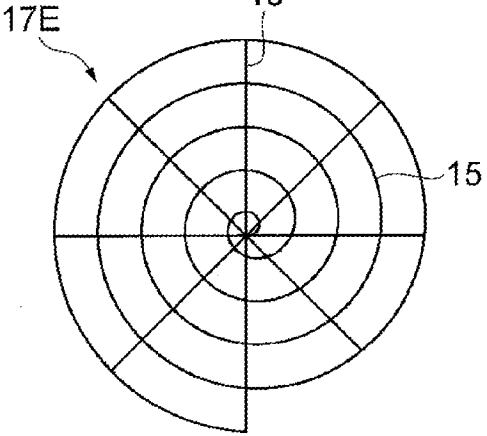

Moreover, the lines of the groove portions 15 are not limited to straight lines, and as shown in FIG. 5*c*, a group of grooves 17C may also be formed by wavy line shaped groove portions 15 arranged in a square lattice. Furthermore, as shown in FIG. 5*d*, a group of grooves 17D may also be formed with lines extending radially from the center through concentrically shaped lines, and a group of grooves 17E may be formed with lines extending radially from the center through spiral shaped lines. By forming a group of grooves 17 like those described above, abrading scraps generated during abrading can smoothly flow in the groove portions 15, and decreases in abrading efficiency due to the abrading scraps clogging the groove portions 15 can be suppressed.

The tip portions 14 are arranged on the base portion 13 such that the density becomes from 0.05 to 300 tip portions 14 per 1 $cm^2$, for example. In this embodiment, the tip portions 14 form a roughly quadrangular prism shape with a height from the substrate layer 11 of around 3 mm and are shaped in a 2×2 matrix shape on the base portion 13, for example. In other words, this type of configuration means that respective groups are formed by a plurality of tip portions 14 sharing a single base portion 13. From a planar view, the top face (abrasive surface) of the tip portions 14 forms, for example, a roughly square shape measuring 3 mm×3 mm. The side surfaces of the tip 14 may also form a tapered shape at the same angle as the tapered shape of the base portion 13, for example.

The number of tip portions 14 formed on the base portion 13 can be appropriately varied with consideration of the following points. When the number of tip portions 14 is low, the abrasive surface and the object for abrasion can be easily contacted at one or multiple points due to the undulation of the surface of the object for abrasion. Therefore, conformance to the roughness of the surface of the object for abrasion tends to be easy. On the other hand, if the number of tip portions 14 is numerous, even if there is undulation in the surface of the object for abrasion, the base portion 13 and the tip portions 14 track the shape of the surface of the object for abrasion due to the flexibility of the substrate layer 11, and the abrasive surface and the object for abrasion can easily contact at multiple points. Accordingly, the amount of abrading and the abrading speed increase, and the degree of finishing tends to increase.

Moreover, neighboring tip portions 14 are partitioned by groove portions 16. As shown in FIGS. 2 and 3, the bottom portion of the groove portions 16 form a rounded shape with a radius of about 0.8 mm on the base portion 13 such that the base portion 13 is exposed at the vertex portion of the bottom portion. By adopting the rounded shape for the bottom portion of the groove portions 16 in this way, the base portion of the side surfaces of the tip 14 has a tapered shape. Accordingly, the surface area of the connection between the tip portions 14 and the base portion 13 is ensured, and the collapse strength of the tip portions 14 when the height of the tip portions 14 is increased can be more reliably increased. Because the volume of the abrasive layer 12 can be thoroughly secured by increasing the height of the tip portions 14, the useful life of the abrasive pad 1 can be further extended.

Note that the shape of the tip 14 may be a columnar body or a frustum shaped body, and for example, may take on a prism shape, a cylindrical shape, an elliptical cylinder shape, a truncated pyramid shape, a circular truncated cone shape, an oval truncated cone shape, or the like. When the tip portions 14 are frustum shaped, similar to the case of the base portion 13, stress is not easily concentrated in the angled parts, and the contact surface area with the base portion 13 is increased. As a result, collapse strength can be more thoroughly maintained.

Figure 6:
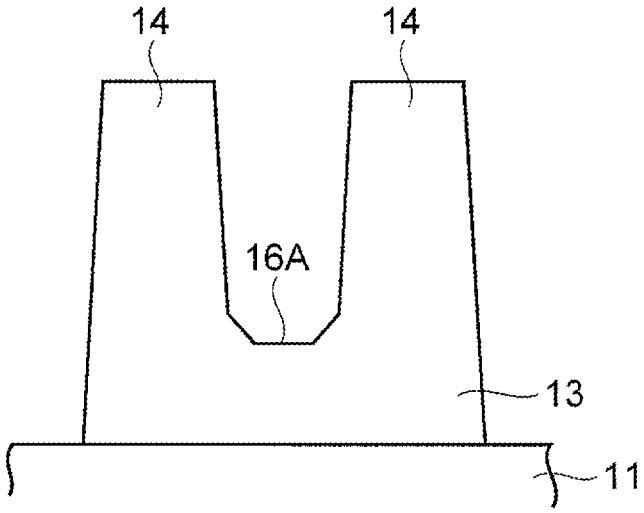
FIG. 6 is a side view showing a variation of a groove portion between tip portions.

Moreover, the shape of the bottom portion of the groove portions 16 is not limited to a rounded shape. For example, similar to the groove portion 16A shown in FIG. 6, the bottom portion of the groove portion 16 may also have a surface shape (including a chamfered shape) in which only the root portions of the side surfaces of the tip 14 are slanted surfaces. In this type of configuration as well, the root portion of the side surface of the tip 14 has a tapered shape. Accordingly, even if the height of the tip portions 14 is increased, the collapse strength of the tip portions 14 can be more reliably increased.

Moreover, the aspect ratio of each of the tip portions 14 becomes from 0.2 to 10. In this range, an extension of the useful life of the abrasive pad 1 can be targeted, and the collapse strength of the tip portions 14 can be thoroughly secured. When the aspect ratio is reduced, the torque applied to the tip portions 14 during abrading decreases, and the collapse strength of the tip portions 14 can be better secured. On the other hand, when the aspect ratio is increased, the volume of the tip portions 14 can be thoroughly secured, and the useful life of the abrasive pad 1 can be further extended. Moreover, because the height of the groove portions 16 increases, the grinding fluid can flow smoothly in the groove portions 16, and clogging of the groove portions 16 by abrading scraps becoming packed therein can be prevented.

As a method to form an abrasive layer 12 like that above, a transfer method can be used, for example. In the transfer method, for example, a mold for which the above tile structure has been applied is set on a platen, and next, a transfer mold is fabricated. This transfer mold is then filled with a curing-type diamond slurry, and a film that becomes the substrate layer 11 is laminated and attached to the slurry. Next, the slurry is cured through optical irradiation, and when the film is peeled from the transfer mold, an abrasive pad 1 having an abrasive layer 12 formed on the substrate layer 11 is obtained. The formation of the abrasive layer 12 is not limited to the transfer method, and may be implemented through machining, embossing by rolls, or the like.

Figure 7A:
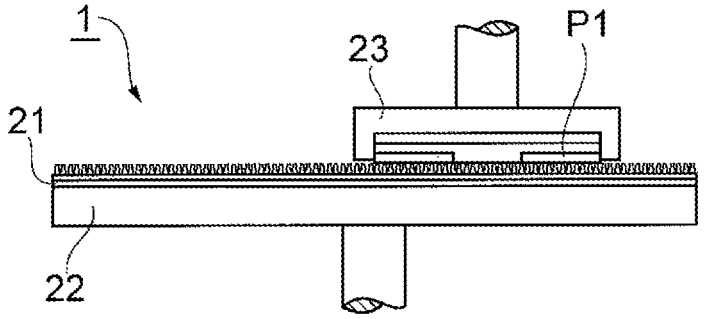
FIGS. 7*a* and 7*b* are side views showing a method for abrading an object to be abraded using the abrasive pad illustrated in FIG. 1.
Figure 7B:
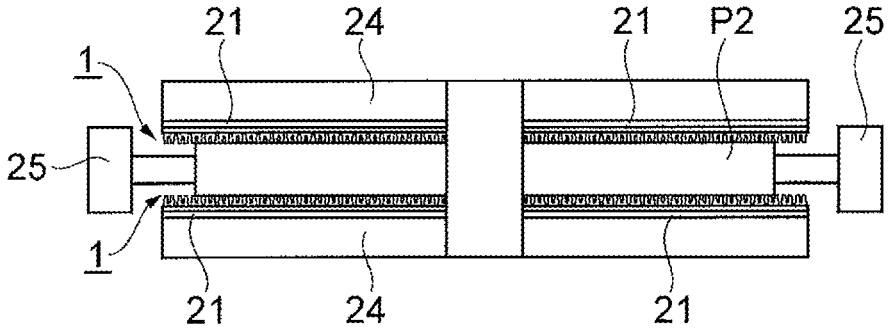

FIGS. 7*a* and 7*b* are illustrations showing an abrading method using an abrasive pad 1. FIG. 7*a* is an example of abrading on one surface, and an object for abrasion P1 is a wire-reinforced glass or a ceramic substrate, for example. In this example, the abrasive pad 1 is secured to the surface of an abrading disc (platen) 22 with an elastic body layer 21 interposed therebetween, the abrading disc 22 is rotated while supplying grinding fluid between the object for abrasion P1 and the abrasive pad 1, and the surface of the object for abrasion P1 is abraded while a load is applied. A retainer 23 that holds the object for abrasion P1 may also be rotated in the same direction as the abrading disc 22 or in an opposite direction thereof.

Moreover, FIG. 7*b* is an example of dual surface abrasion, and an object for abrasion P2, which is the target of abrasion, is a large glass substrate or a metal plate, for example. In this example, respective abrasive pads 1 are secured to the surface of top and bottom abrading discs 24 with a layer 21 having flexibility interposed between each abrasive pad 1 and abrading disc 24, and an object for abrasion P2 that is held by a retainer 25 is set between the abrading discs 24. The abrading discs 24 are rotated while supplying grinding fluid between the object for abrasion P2 and the abrasive pads 1, and both surfaces of the object for abrasion P2 are abraded while a load is applied. At this time, rotation of the abrading discs 24 in mutually opposite directions is preferred.

In the above examples, attachment of the abrasive pads 1 to the abrading discs 22 and 24 can be done using, for example, a pressure sensitive type adhesive. Examples of this type of adhesive include latex crepe, rosin, polyacrylate ester, acrylic polymer, polybutylacrylate, vinyl ethers (for example, polyvinyl n-butyl ether), alkyd adhesives, rubber adhesives (for example, natural rubber, synthetic rubber, and chlorinated rubber), and mixtures thereof.

Moreover, examples of materials that can be used as the layer 21 having flexibility include polyurethane foam, rubber, elastomer, rubber foam, and the like. By interposing this type of layer 21, the tracking capability of the shape of the abrasive pad 1 with regards to the abrading discs 22 and 24 can be improved. Note that the layer 21 having flexibility may also be provided in advance on the second surface side (opposite surface side of the abrasive layer 12) of the substrate layer 11 in the abrasive pad 1. Moreover, the layer 21 having flexibility does not necessarily have to be provided, and the abrasive pad 1 may be directly attached to the abrading discs 22 and 24.

Examples of grinding fluids include water-based solutions containing one or more types of the following: amines, mineral oil, kerosene, mineral spirits, water-soluble emulsions, polyethylenimine, ethylene glycol, monoethanolamine, diethanolamine, triethanolamine, propylene glycol, amine borate, boric acid, amine carboxylate, pine oil, indole, thioamine salt, amides, hexahydro-1,3,5-triethyltriazine, carboxylic acid, sodium 2-mercaptobenzothiazole, isopropanolamine, triethylenediamine tetraacetic acid, propylene glycol methyl ether, benzotriazole, sodium 2-pyridinethiol-1-oxide, and hexylene glycol. The grinding fluid may also contain corrosion inhibitors, bactericides, stabilizers, surfactants, emulsifiers, or the like.

When this type of object for abrasion P is abraded, as described above, with the abrasive pad 1, the abrasive layer 12 has base portions 13 arranged mutually separated on the substrate layer 11, and roughly prism shaped tip portions 14 arranged mutually separated on the base portions 13. In other words, with this abrasive layer 12, individual groups are formed by a plurality of roughly prism shaped tip portions 14 sharing a single base portion 13, and the collapse strength of the tip portions 14 is thoroughly ensured. Moreover, with this abrasive pad 1, the base portions 13 are mutually segregated by groove portions 15, and portions not having abrasive material exist between neighboring groups. Therefore, the flexibility of the abrasive pad 1 is thoroughly secured, unlike a case in which all of the tip portions 14 are connected at the base portion 13.

Figure 8A:
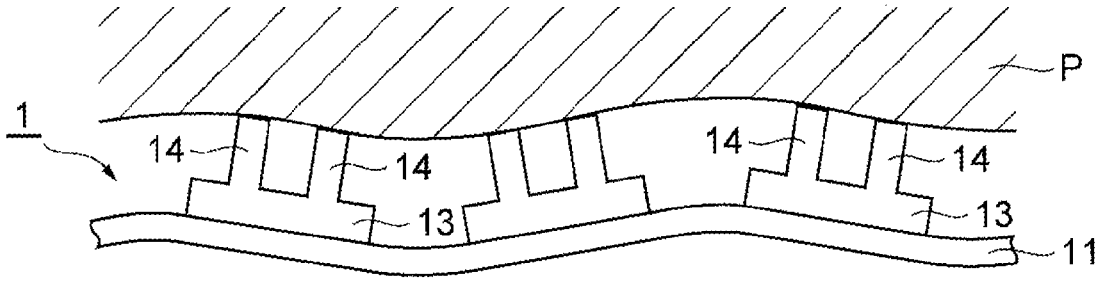
FIGS. 8*a-c* are illustrations schematically showing the functional effects of the abrasive pad.

Accordingly, with the abrasive pad 1, as schematically shown in FIG. 8*a*, when an object for abrasion P is abraded, the substrate layer 11 bends and tracks the surface undulations of the object for abrasion P, and in this manner, the abrasive surfaces of the tip portions 14, which are formed into groups on each base portion 13, come into close contact with the object for abrasion P, and optimal abrading can be implemented. Moreover, with the abrasive pad 1, the collapse strength of the tip portions 14 for collapse originating with peeling of the base portion 13 from the substrate layer 11 is ensured through a connection with the base portions 13, and the stress applied to the tip portions 14 can be reduced by the tracking of the shape of the substrate layer 11. Accordingly, even if the height of the tip portions 14 is increased, breakage and peeling of the tip portions 14 can be suppressed. Furthermore, because the volume of the abrasive layer 12 can be thoroughly secured by increasing the height of the tip portions 14, the useful life of the abrasive pad 1 can be extended.

Note that a decrease in the flatness of the abrasive layer 12 due to contraction when the resin in the abrasive material is light cured can also be suppressed by segregating the base portions 13 with groove portions 15 on the abrasive pad 1, and variations in the height of the tip portions 14 (tile height) can be suppressed. Moreover, by segregating the base portions 13, even in cases in which bending or other forces are applied to the abrasive layer 12, decreases in the collapse strength of the tip portions 14 due to cracks forming in the abrasive layer 12 as a result of bending of the abrasive layer 12 in portions not having abrasive material can also be suppressed.

Moreover, on the abrasive pad 1, the bottom portion of the groove portions 16 between the tip portions 14 forms a rounded shape on the base portion 13, and the bottom portion of the groove portions 15 between the base portions 13 forms a rounded shape on the substrate layer 11. Through this type of configuration, the collapse strength of the tip portions 14 is further increased on the abrasive pad 1, and breakage and peeling of the tip portions 14 can be more reliably suppressed.

Figure 8B:
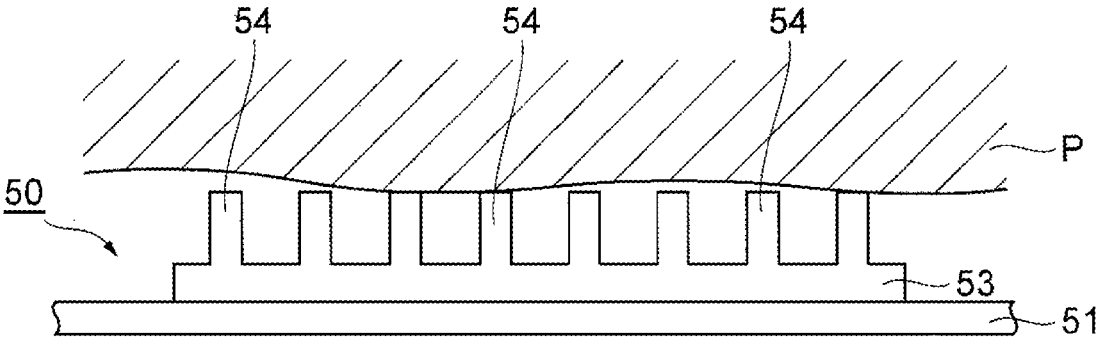

In contrast, for example as schematically shown in FIG. 8*b*, with a conventional abrasive pad 50 that has all of the tip portions 54 connected on a single base portion 53, there is a concern that the flexibility of a substrate layer 51 may decrease due to the integrated form of the abrasive layer. When a decrease in the flexibility of the substrate layer 51 occurs, the abrasive surface of the tip portions 54 does not track the surface undulations of the object for abrasion P, stress is excessively applied to the tip portions 54, and there is a concern that breakage of the tip portions 54 may occur. Moreover, with the base portion 53 having an integrated form, in cases in which bending or other forces are applied to the abrasive pad 50, there is a concern that the collapse strength of the tip portions 54 may decrease due to cracks forming in the base portion 53.

Figure 8C:
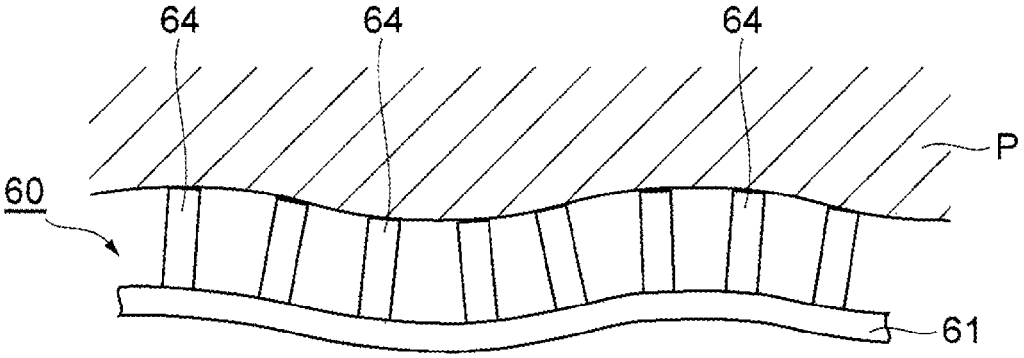

Moreover, as shown schematically in FIG. 8*c*, with a conventional abrasive pad 60 for which a base portion is not provided and all of the tip portions 64 are formed directly on a substrate layer 61, while there is no problem with the flexibility of the substrate layer 61, there is a possibility that the collapse strength cannot be sufficiently secured when the height of tip portions 64 is increased. In this case, the stress applied to the abrasive pad 60 when abrading is concentrated in the root portion of the tip portions 64, and there is a concern that the tip portions 64 may peel easily from the substrate layer 61. Accordingly, the adoption of a configuration in which a plurality of tip portions 14 are grouped by base portions 13, as with the abrasive pad 1, is useful from the viewpoint of extending the useful life of the abrasive pad and ensuring the flatness and flexibility of the abrasive layer.

Moreover, the presence of constant undulation in the surface of the object for abrasion, which is the target of abrading, is as described above, but constant undulation is also present in the abrading disc, conveyor, and other components on the abrading equipment side. The abrading disc is ordinarily hard, and therefore, changing the shape of the undulation is difficult. Accordingly, giving the substrate layer 11 flexibility, and appropriately selecting the thickness and other conditions to provide the abrasive pad 1 with allowance for deformation is effective. Ease of attachment of the abrasive pad 1 on the abrading disc can also be secured by giving the substrate layer 11 ample flexibility. Moreover, particularly when surface undulation of the object for abrasion and undulation on the abrading equipment side cannot be canceled with flexibility of the substrate layer 11 alone, the installation of a layer 21 having flexibility on the second surface side of the substrate layer 11 is effective. By interposing a flexible layer 21 between the abrasive pad 1 and the abrading disc, the tracking capability of the abrasive pad 1 side can be further improved, and more optimum abrading can be implemented.

As explained above, functional benefits like those that follow are accomplished according to aspects of the present invention.

One aspect of the present invention is an abrasive pad used to abrade the surfaces of glass, ceramic, and metal materials, the abrasive pad being provided with a substrate layer, and an abrasive layer provided on a first surface side of the substrate layer and including an abrasive material, and the abrasive layer having a plurality of base portions arranged mutually separated on the substrate layer, columnar or frustum shaped tip portions arranged mutually separated on the base portions, and a group of grooves containing a plurality of groove portions provided between base portions such that the substrate layer is exposed between the base portions, with each of the grooves mutually intersecting.

With this abrasive pad, individual groups are formed by tip portions sharing a single base portion, and the collapse strength of the tip portions is thoroughly ensured. Moreover, with this abrasive pad, the flexibility of the abrasive pad is thoroughly ensured because the base portions are mutually segregated by groove portions, and portions not having abrasive material exist between neighboring groups. Accordingly, with this abrasive pad, when an object for abrasion is abraded, the substrate layer bends and tracks the surface undulations of the object for abrasion, thereby enabling optimal abrading to be performed. Moreover, with this abrasive pad, the collapse strength of the tip portions is ensured through a connection with the base portions, and the stress applied to the tip portions can be alleviated by the tracking of the shape of the substrate layer. Accordingly, even if the height of the tip portions is increased, breakage and peeling of the tip portions can be suppressed. Furthermore, because the volume of the abrasive layer can be thoroughly secured by increasing the height of the tip portions, the useful life of the abrasive pad can be extended.

Moreover, with another aspect, a surface area of a top face of the base portion is from 30 $mm^2$ to 400 $mm^2$. By selecting a range such as this, a sufficient number of tip portions can be arranged on the base portion, and an abrading region can be thoroughly ensured. If the surface area of the base portion is too large, there is a concern that the flexibility of the substrate layer may be lost. On the other hand, if the surface area of the base portion is too small, there is a concern that a decrease in abrading workability may occur. Accordingly, in the above range of surface areas, both the strength of the base portion and the flexibility of the substrate layer can be ensured.

Moreover, with another aspect, the bottom portion of the groove portions between the tip portions forms a tapered shape on the base portion. Through this, the surface area of the connection between the tip portions and the base portion is ensured, and the collapse strength of the tip portions can be further increased.

Moreover, with another aspect, the bottom portion of the groove portions between the base portions forms a tapered shape on the substrate layer. Through this type of configuration, the contact surface area between the substrate layer and the base portion can be thoroughly maintained, and the joint strength with regards to the substrate layer can be ensured. Moreover, because the root portion of the base portion does not form a notch, localized stress concentration in the root portion of the base portion during abrading can be prevented.

Moreover, with another aspect, the substrate layer is formed of a material having flexibility. Giving the substrate layer flexibility to provide the abrasive pad side with allowance for deformation is effective. In this manner, surface undulation of the object for abrasion and undulation of the platen to which the abrasive pad is attached, or the like, can be absorbed, and optimal abrading can be implemented. Moreover, as described above, because portions not having abrasive material exist between the base portions, hindrance of the flexibility of the substrate layer due to the abrasive layer can be avoided.

Moreover, with another aspect, a layer having flexibility is provided on the second surface side of the substrate layer. In this case, even in cases in which surface undulation of the object for abrasion and undulation of the platen to which the abrasive pad is attached, or the like, cannot be absorbed by the flexibility of the substrate layer alone, the tracking capability of the abrasive pad side can be ensured and optimal abrading can be implemented through a layer having flexibility.

Moreover, with another aspect, the aspect ratio of the tip is from 0.2 to 10. In this range, an extension of the useful life of the abrasive pad can be targeted, and the collapse strength of the tip portions can be thoroughly maintained. When the aspect ratio is reduced, the torque applied to the tip portions during abrading decreases, and the collapse strength of the tip portions can be better secured. On the other hand, when the aspect ratio is increased, the volume of the tip portions can be thoroughly secured, and the useful life of the abrasive pad 1 can be further extended. Moreover, because the height of the groove portions between the tip portions increases, the grinding fluid can flow smoothly in the groove portions, and clogging of the groove portions by abrading scraps becoming packed therein can be prevented.

Moreover, one aspect of the present invention is a method for abrading glass, ceramic, and metal materials using the above abrasive pad. The method includes a process of securing the second surface side of the substrate layer on a platen, bringing the abrasive layer and object for abrasion into contact, and then relatively rubbing the abrasive pad and a grinding fluid against the object for abrasion, while introducing the grinding fluid between the object for abrasion and the abrasive layer.

With this abrading method, when an object for abrasion is abraded using the abrasive pad described above, the substrate layer bends and tracks the surface undulations of the object for abrasion and the surface undulations of the platen, thereby enabling optimal abrading to be performed. On the abrasive pad side, the collapse strength of the tip portions is ensured through a connection with the base portions, and the stress applied to the tip portions can be alleviated by the tracking of the shape of the substrate layer. Accordingly, even if the height of the tip portions is increased, breakage and peeling of the tip portions can be suppressed, and because the volume of the abrasive layer can be thoroughly secured, the useful life of the abrasive pad can also be extended.

Next, a test to confirm the benefits of the present invention is described.

In this test, samples of abrasive pads having abrasive layers with different shapes were respectively fabricated, and then the leading edge of each of the tiles was inserted between a bolt and a nut, and the collapse strength when the lower part was pulled was measured by a tensile tester.

FIGS. 9*a-e* are side views showing shapes of abrasive pad samples according to embodiments and comparative examples. With a sample S1 of a Comparative Example 1 shown in FIG. 9*a*, a base portion was not provided, and roughly prism shaped protrusion portions 102 having a height of 0.8 mm were arranged on a substrate layer 101 to form an abrasive layer 103. Moreover, the surface area of the abrasive surface was 2.6 mm×2.6 mm.

Figure 9A:
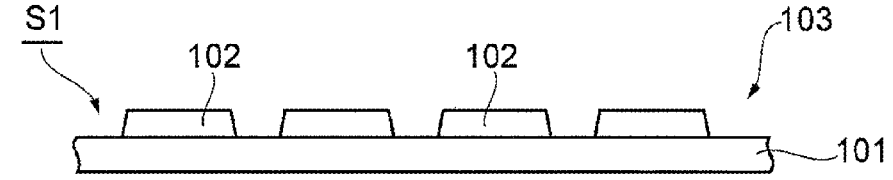
FIGS. 9*a-e* are side views showing shapes of abrasive pad samples according to embodiments and comparative examples.
Figure 9B:
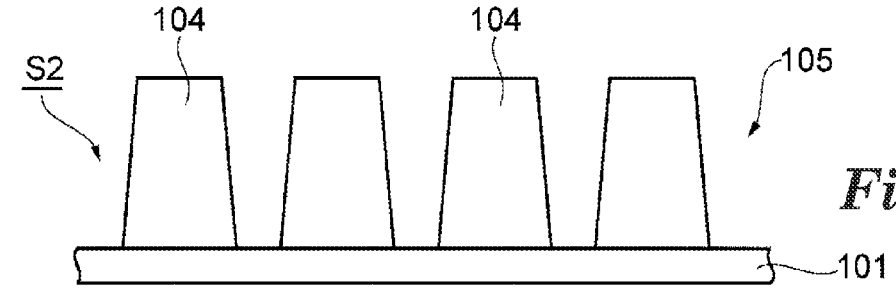
Figure 9C:
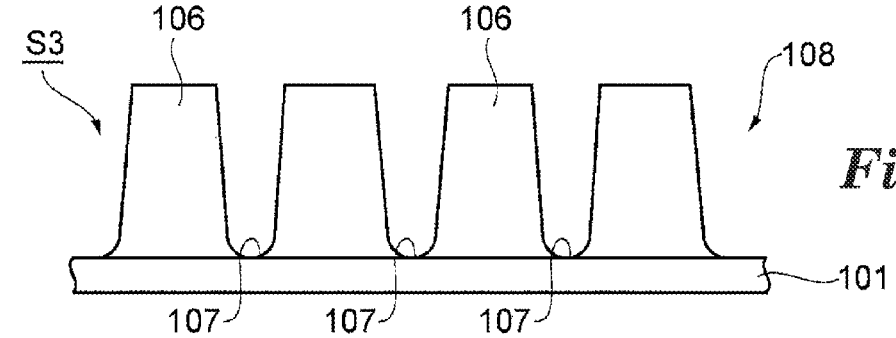

With a sample S2 of a Comparative Example 2 shown in FIG. 9*b*, a base portion was not provided, and roughly prism shaped protrusion portions 104 having a height of 5 mm were arranged on a substrate layer 101 to form an abrasive layer 105. Moreover, the surface area of the abrasive surface was 3 mm×3 mm. With a sample S3 of a Comparative Example 3 shown in FIG. 9*c*, a base portion was not provided, roughly prism shaped protrusion portions 106 having a height of 5 mm were arranged on a substrate layer 101, and an abrasive layer 108 was established with bottom portions of groove portions 107 between neighboring protrusion portions 106 having a rounded shape with a radius of 0.8 mm. Moreover, the surface area of the abrasive surface was 3 mm×3 mm.

Figure 9D:
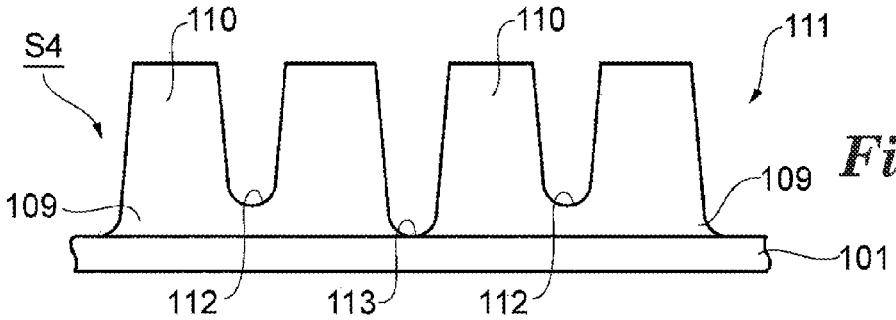
Figure 9E:
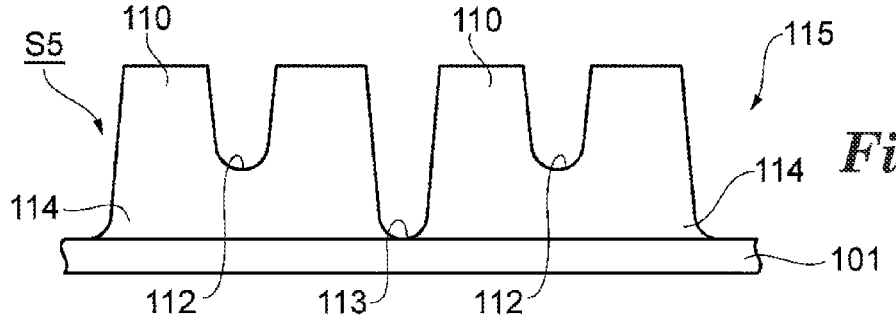

With a sample S4 of an Embodiment 1 shown in FIG. 9*d*, base portions 109 having a height of 1 mm were arranged on a substrate layer 101, roughly prism shaped tip portions 110 were arranged on the base portions 109 such that the height from the substrate layer 101 became 5 mm, and an abrasive layer 111 was established. Moreover, the bottom portions of groove portions 112 between the tip portions 110 and the bottom portions of groove portions 113 between the base portions 109 were each formed having a rounded shape with a radius of 0.8 mm. The surface area of the abrasive surface was 3 mm×3 mm. With a sample S5 of an Embodiment 2 shown in FIG. 9*e*, an abrasive layer 115 is provided with a similar structure as Embodiment 1 with the exception that the height of a base portion 114 was 2 mm.

Figure 10:
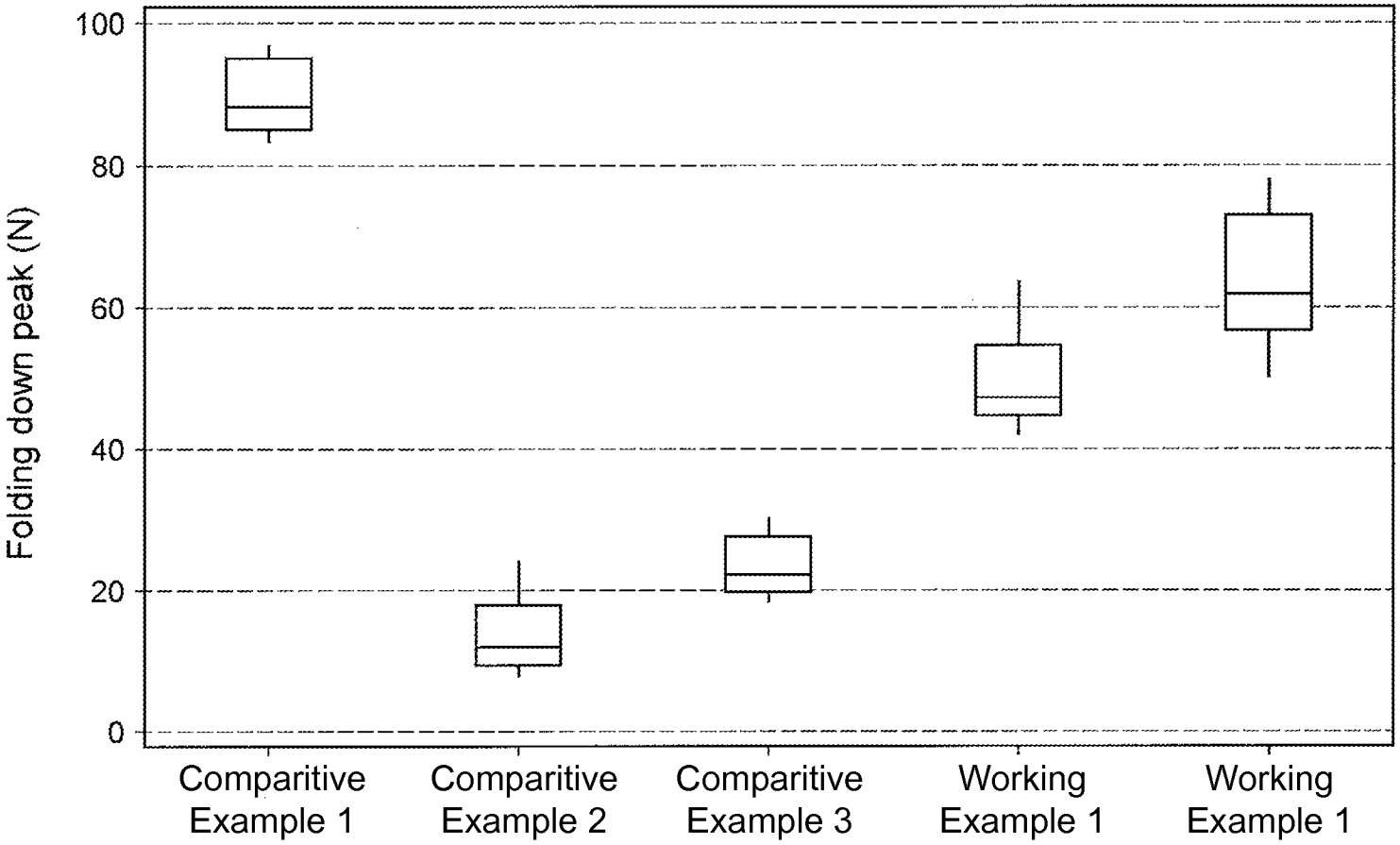
FIG. 10 is an illustration showing the results of a test to confirm benefits.

FIG. 10 is an illustration showing the test results thereof. As shown in this figure, in Comparative Example 1 wherein the height of the protrusion portion is low, the collapse strength is naturally high, but the collapse strength of Embodiment 1 in which the tip portions are formed into groups by base portions is improved roughly four times compared to the Comparative Example 2 that does not have base portions and roughly two times compared to the Comparative Example 3. Moreover, the collapse strength of Embodiment 2, which has a thick base portion, is further improved 1.3 times compared to Embodiment 1.

What is claimed is:

1. An abrasive pad used to abrade the surfaces of glass, ceramic, and metal materials; the abrasive pad comprising:

a substrate layer; and an abrasive layer provided on a first surface side of the substrate layer and comprising an abrasive material;

and the abrasive layer comprising:

a plurality of base portions arranged mutually separated on the substrate layer;

columnar or frustum shaped tip portions arranged mutually separated on the base portions; and a group of grooves containing a plurality of groove portions provided between base portions such that the substrate layer is exposed, with each of the grooves mutually intersecting.

2. The abrasive pad according to claim 1, wherein a surface area of a top face of the base portion is from 30 $mm^2$ to 400 $mm^2$.

3. The abrasive pad according to claim 1, wherein a bottom portion of the groove portions between the tip portions forms a tapered shape on the base portion.

4. The abrasive pad according to claim 1, wherein a bottom portion of the groove portions between the base portions forms a tapered shape on the substrate layer.

5. The abrasive pad according to claim 1, wherein the substrate layer is formed of a material having flexibility.

6. The abrasive pad according to claim 1, wherein a layer having flexibility is provided on a second surface side of the substrate layer.

7. The abrasive pad according to claim 1, wherein, an aspect ratio of the tip portions is from 0.2 to 10.

8. A method for abrading glass, ceramic, and metal materials using an abrasive pad according to claim 1;

the abrading method comprising a process of securing the second surface side of the substrate layer on a platen, bringing the abrasive layer and object for abrasion into contact, and then relatively rubbing the abrasive pad and a grinding fluid against the object for abrasion, while introducing the grinding fluid between the object for abrasion and the abrasive layer.

* * * * *